United States Patent [19]

Matthews

[11] Patent Number: 4,717,176

[45] Date of Patent: Jan. 5, 1988

[54] BOOKLET

[76] Inventor: Lowell Matthews, 11188 Western Ave., Stanton, Calif. 90680

[21] Appl. No.: 776,832

[22] Filed: Sep. 17, 1985

[51] Int. Cl.[4] ..... B42D 5/00; B42D 1/00; B42D 3/12; B65D 27/08

[52] U.S. Cl. ..... 281/15 R; 281/31; 282/23 R; 229/68 R

[58] Field of Search ..... 281/15 R, 15 B, 16, 281/31; 282/23 R, 24 A, 22 A; 283/81, 101, 105; 229/68 R, 70, 73, 74, 92.1

[56] References Cited

U.S. PATENT DOCUMENTS

| | | | |
|---|---|---|---|
| 521,727 | 6/1894 | Morgan . | |
| 619,054 | 2/1899 | Strauss et al. . | |
| 1,787,276 | 12/1930 | Jones . | |
| 2,092,127 | 9/1937 | Lankton | 282/23 R |
| 2,108,749 | 2/1938 | Harris . | |
| 2,382,476 | 8/1945 | Glasoe, Jr. | 281/31 |
| 2,828,975 | 4/1958 | Wright | 281/31 |
| 3,154,305 | 10/1964 | Pollard | 282/23 R |
| 3,275,316 | 9/1966 | Gleary, Jr. | 229/73 |
| 3,310,321 | 3/1967 | Freund . | |
| 3,460,744 | 8/1969 | Turkenkopf | 229/68 R |
| 3,520,560 | 7/1970 | Isaac . | |
| 3,930,700 | 1/1976 | Figueres . | |
| 4,492,390 | 1/1985 | Jacobs et al. | 281/31 |
| 4,534,581 | 8/1985 | Engh | 281/15 R |

*Primary Examiner*—E. R. Kazenske
*Assistant Examiner*—Paul M. Heyrana, Sr.
*Attorney, Agent, or Firm*—Dickstein, Shapiro & Morin

[57] ABSTRACT

A booklet having a cover with an inside and outside surface and having at least one fold in the cover to define a number of cover portions separated by the cover fold or folds. The booklet further includes an insert having an inside and outside surface and at least one fold to define the number of insert portions separated by the insert fold or folds. The insert is attached to the cover along corresponding folds so that the outside surface of the insert faces the inside surface of the cover. At least one leaf is attached at one of its edges to the insert near an attached insert fold. The leaf or leaves may be removable for subsequent use. For example, envelopes may comprise the leaves. Alternatively or additionally the leaves may have removable portions such as stickers, blister packs and the like applied to them.

25 Claims, 5 Drawing Figures

50

62
66
64
60

72
70

ENVELOPE, BLISTER PACK SHEET,
STICKER SHEET, VACUUM PACK SHEET,
PRINTED MATERIAL SHEET
30
29
27
28
26
20
18
21
24
42
43
22
16
15
14
12
36
35
34
40
34
32
13
37
41
11
10
82
84
80
86

BOOKLET

BACKGROUND

The present invention relates to a booklet in general and more particularly to the construction of a booklet including removable portions.

Booklets having removable portions are useful for promotional, advertising, educational, instructional, entertainment and product distribution purposes. For example, promotional packages used in advertising may include a number of sample products. These sample products may be medications, envelopes, stickers, printed matter and the like. It is advantageous to present promotional material in advertising in a form that is easily removable and compact. A booklet form is highly desirable for such promotional packages.

Known booklet constructions include those described in U.S. Pat. Nos. 521,727 to Morgan; 619,054 to Strauss, et al.; 1,787,276 to Jones; 2,108,749 to Harrison; 3,310,321 to Freund; 3,520,560 to Isaac; and 3,930,700 to Figueres.

The Morgan patent discloses a checkbook having a number of checks gummed at their edge and secured to section D of leaf C which is in turn secured to the center of the book insert. The gummed checks form a sub-booklet attached to the outer edge of leaf C. This booklet construction has the disadvantage that leaf C is likely to rip and tear due to the weight of the sub-booklet of checks at its outer edge.

Figueres discloses a booklet having a page in which rolodex cards are formed by perforation. The other patents show other embodiments of coupon and label booklets.

SUMMARY OF THE INVENTION

The present invention provides a booklet having a cover with an inside and outside surface and having at least one fold in the cover to define the number of cover portions separated by the cover fold or folds. The booklet further includes an insert having an inside and outside surface and at least one fold to define the number of inset portions separated by the insert fold or folds. The insert is attached to the cover along corresponding folds so that the outside surface of the insert faces the inside surface of the cover. At least one leaf is attached at one of its edges to the insert near an attached insert fold.

The leaf or leaves may be removable for subsequent use. For example, envelopes may comprise the leaves. Alternatively or additionally, the leaves may have removable portions applied to them. An example of this would include a waxy-like leaf with removable stickers applied thereto.

It is an object of the invention provide an improved booklet having removable portions.

It is a further object of the invention to provide a booklet yielding the foregoing advantages and that is simple and easy to construct.

It is yet another object of the present invention to provide a booklet yielding the foregoing advantages and which is versatile and may include a variety of types of removable materials.

Other objects and advantages of the present invention will be readily apparent from the following description and drawing which illustrate a preferred embodiment of the present invention.

DESCRIPTION OF THE PREFERRED EMBODIMENT

Figures 1, 2, 3, 4, 5:
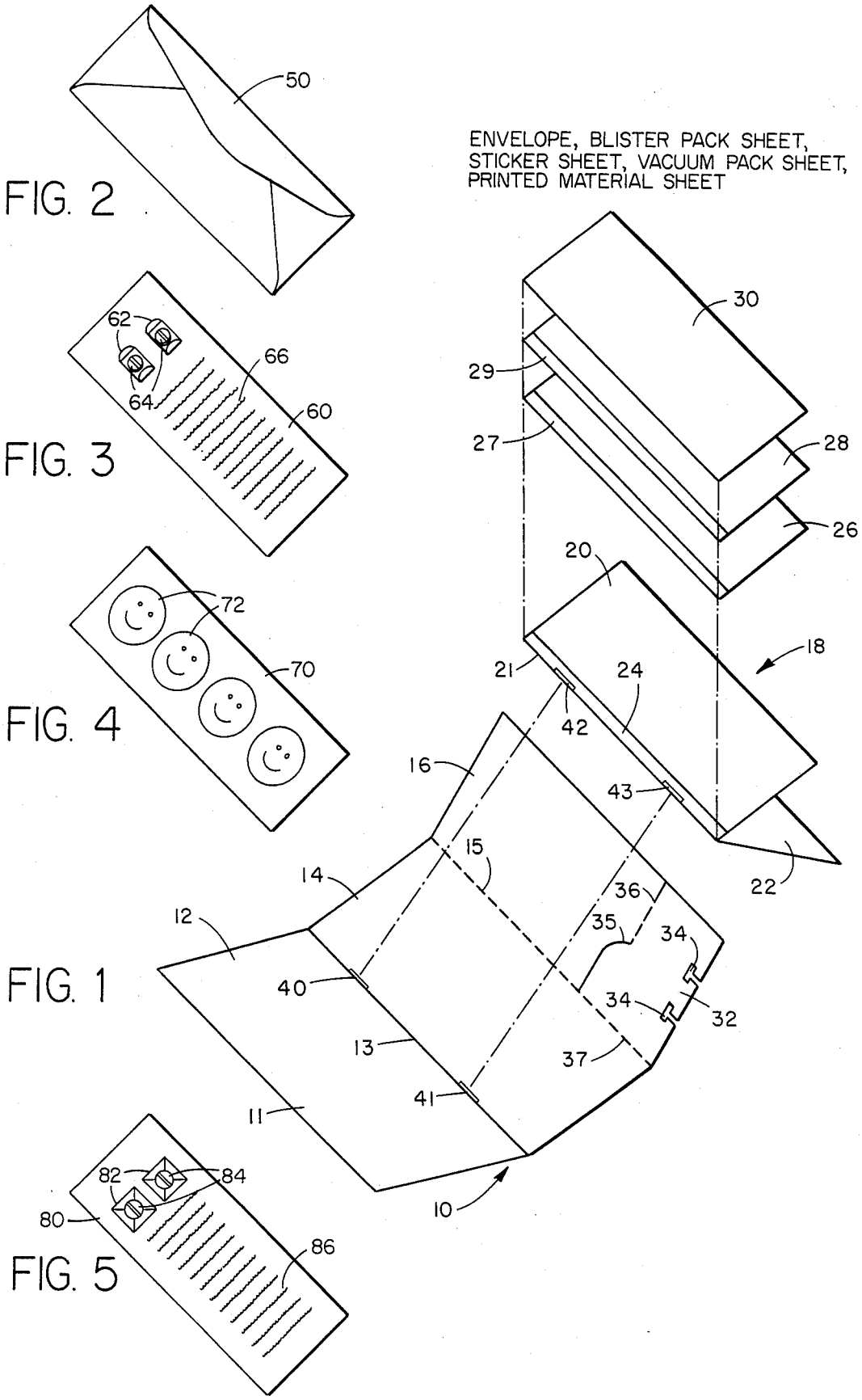
FIG. 1 is an exploded view of a booklet according to the present invention.
FIGS. 2 through 5 illustrate alternate embodiments of the leaves of the booklet of FIG. 1.

Referring to FIG. 1, therein is shown an exploded view of a preferred embodiment of a booklet, generally designated by reference numeral 10, according to the present invention. Booklet 10 includes a cover 11 which is folded twice at folds 13 and 15 to form three cover portions 12, 14, and 16. Cover 11 is perforated along fold 15 so that portion 16 may be easily removed to serve as a postcard or for other purposes. As shown in the Figure, portion 16 includes a rolodex card 32 defined by slit 35, perforation 36 and perforation 37 along fold 15. Card 32 is stamped to form punch-outs 34 that can be easily removed for positioning removed card 32 on the dual rods of the rolodex arrangement.

Booklet 10 further includes an insert 18 having a fold 21 that defines insert portions 20 and 22. Insert 18 is affixed, at fold 21, to cover 11 at fold 13. Insert 18 is affixed to cover 11 at sites 42 and 43 of fold 21 and corresponding respective sites 40 and 41 of cover 11.

Insert 18 may be affixed to cover 11 by wire stitching such as staples, or thread stitching or other suitable means which will allow portions 20 and 22 of insert 18 to function as leaves within booklet 11 upon being affixed.

Leaves 26, 28 and 30 are affixed by applying adhesive or gumming to their edges. As shown in FIG. 1, insert portion 20 has adhesive 24 applied to its inner edge along fold 21. Leaf 26 is adhered along its inner edge to insert 18 by adhesive 24. Leaf 26 also includes an adhesive 27 along its inner edge proximate fold 21 on the side of leaf 26 facing away from insert portion 20. Leaf 28 is in turn, adhered to leaf 26 by adhesive strip 27. Leaf 28 also has an adhesive strip 29 applied to the upper side of its edge adhered to leaf 26. Leaf 30 is adhered to leaf 28 by adhesive strip 29.

Although three leafs are shown in FIG. 1, as many leaves as desired may be affixed in this manner.

An alternate method of affixing the leaves to one another is to first stack the leaves and then adhere them along one common edge by applied gum. This gummed, or padded, assembly would then be affixed to insert 18 by adhesive strip 24. Alternatively, insert 18 could be included in the stack when the gum is applied so that all of the leaves as well as insert 18 are gummed together.

As shown in FIG. 1, leaves 26, 28 and 30 are all approximately the same size. In an alternate construction, the leaves can be of varying sizes as long as sufficient adhesion to one another can be obtained.

The leaves 26, 28 and 30 may be made of any material with an edge capable of being adhered as described herein or capable of being padded into a booklet. For example, a common paper sheath, pressure sensitive label stock, dry gum label stock, envelopes, vacuum packs or blister packs, and photographs as well as other materials and combinations thereof can be included as leaves 26, 28 and 30.

Insert 18 may be made of any material that is capable of being folded, stitched or stapled and that will accept adhesive for holding the leaves 26, 28 and 30.

Insert 18 is affixed by stapling or stitching inside the booklet cover at fold 21 with the leaves affixed either on the inside surfaces of insert portions 20 and 22 or the outside surfaces thereof, along and proximate to fold 21. The inside surfaces are those surfaces, with respect to a fold, facing each other upon folding. The outside surfaces are those surfaces, with respect to a fold, facing away from each other upon folding. A surface may be an inside surface with respect to one fold and simultaneously an outside surface with respect to another fold.

Cover 11 may be made of any material capable of being folded, stitched or stapled.

One construction of leaves 26, 28 and 30 can be a waxie-type paper having removable stickers positioned thereon are held thereto by pressure sensitive adhesive. Moreover packs may be used for incorporating samples of items, such as medicines, in a promotional package.

FIGS. 2 through 5 illustrate a number of alternate embodiments of the leaves. FIG. 2 illustrates a leaf made up of an envelope 50. FIG. 3 illustrates a leaf made up of a blister pack sheet 60 having blister portion 62 containing medicines 64 and also including printed material 66. The construction of blister packs is well known in the art. FIG. 4 illustrates a leaf made up of sticker sheet 70 including sticker 72. FIG. 5 illustrates a leaf made up of a vacuum pack sheet 80 including vacuum packs 82 containing medicine 84 and printed material 86.

In FIG. 1, insert 18 has a single fold defining two portions 20 and 22. Optionally, the insert may have more than one fold and define a corresponding greater number of insert portions. Although FIG. 1 illustrates the use of a single insert, multiple inserts can be incorporated within a single cover. Multiple inserts can be either "nested" one within the other and attached to a common cover fold, or separately attached to different cover folds. The insert portions shown in the Figure are approximately the same size and shape, however, the invention is not limited thereto and the insert portions size and shape may be chosen as desired provided the adhesion of the leaves to an affixed portion proximate the fold thereof may be effected.

Also, FIG. 1 illustrates cover 11 as having two folds 13 and 15. Alternatively, cover 11 may have a different number of folds. Moreover, the cover portions, such as portions 12, 14 and 16 of the embodiment shown in the Figure, need not be approximately the same size.

The use of the booklet is not limited to promotional and advertising purposes. It can also be used for educational, instructional, entertainment and product distribution purposes.

The above description and drawing is only illustrative of a preferred embodiment that achieves the objects, features and advantages of the present invention and it is not intended that the present invention be limited thereto. Any modifications of the present invention which come within the spirit and scope of the following claims are considered part of the present invention.

What is claimed is new and desired to be secured by Letters Patent of the United States is:

1. A booklet comprising: a cover having inside and outside surfaces and having at least one cover fold to define a plurality of cover portions separated by said at least one cover fold; at least one insert having inside and outside surfaces and having at least one insert fold to define a plurality of insert portions separated by said at least one insert fold; insert attachment means for attaching at least one of said at least one insert fold to said cover at at least one of said at least one cover fold with at least a portion of said insert outer surface facing said cover inner surface; and at least one leaf having an edge and being attached at said edge to one of said insert portions proximate one of said attached insert folds.

2. A booklet as in claim 1 wherein said at least one leaf is attached to said insert portion by an adhesive.

3. A booklet as in claim 2 wherein said insert portion and said leaves are formed into a pad by adhesive applied along said attached folds and respective aligned edges of said leaves.

4. A booklet as in claim 3 wherein said edges are approximately the same length.

5. A booklet as in claim 4 wherein said leaves are approximately the same size.

6. A booklet as in claim 5 wherein said cover has two of said folds to form three of said cover portions.

7. A booklet as in claim 6 wherein at least one insert portion is attached to one of said folds and the other of said folds is perforated to enable easy removal of one of said cover portions.

8. A booklet as in claim 7 wherein said removable cover portion has one or both of perforations in slots to form a rolodex card which may be easily removed.

9. A booklet as in claim 2 wherein said adhesive is applied between said at least one leaf and said insert substantially along the length of said one of said attached insert folds.

10. A booklet as in claim 9 wherein there are a plurality of leaves attached together.

11. A booklet as in claim 10 wherein said leaves are attached by adhesive applied between respective adjacent leaves.

12. A booklet as in claim 10 wherein said leaves are formed into a pad by adhesive applied along respective aligned edges of said leaves.

13. A booklet as in claim 11 wherein each of said leaves has an edge and said adhesive is applied substantially along said edge over at least a portion of the respective coextensive lengths of said edges of said leaves.

14. A booklet as in claim 13 wherein said edges are approximately the same length.

15. A booklet as in claim 14 wherein said leaves are approximately the same size.

16. A booklet as in claim 1 wherein said insert is attached by wire or thread, staples or stitching.

17. A booklet as in claim 1 wherein said at least one leaf is removeably attached to said inset portions.

18. A booklet as in claim 17 wherein said at least one leaf includes at least one envelope.

19. A booklet as in claim 17 wherein said at least one leaf includes at least one printed material sheet.

20. A booklet as in claim 1 wherein said at least one object is removeably secured to said at least one leaf.

21. A booklet as in claim 20 wherein said at least one leaf includes at least one sticker label sheet and said at least one object includes at least one sticker.

22. A booklet as in claim 20 wherein said at least one leaf includes at least one pack sheet and said at least one object is held by at least one pack of said pack sheet.

23. A booklet as in claim 22 wherein said at least one pack includes at least one blister pack.

24. A booklet as in claim 22 wherein said at least one pack includes at least one vacuum pack.

25. A booklet as in claim 22 wherein said at least one object includes medicine.

* * * * *